US007556033B2

(12) United States Patent
Kim

(10) Patent No.: US 7,556,033 B2
(45) Date of Patent: Jul. 7, 2009

(54) DOOR OPENING AND CLOSING SYSTEM IN ELECTRIC OVEN

(75) Inventor: Hag Sin Kim, Kimhae-si (KR)

(73) Assignee: LG Electronics Inc., Seoul (KR)

( * ) Notice: Subject to any disclaimer, the term of this patent is extended or adjusted under 35 U.S.C. 154(b) by 748 days.

(21) Appl. No.: 10/524,409

(22) PCT Filed: Jul. 13, 2004

(86) PCT No.: PCT/KR2004/001729

§ 371 (c)(1),
(2), (4) Date: Feb. 14, 2005

(87) PCT Pub. No.: WO2005/008137

PCT Pub. Date: Jan. 27, 2005

(65) Prior Publication Data

US 2005/0248163 A1 Nov. 10, 2005

(30) Foreign Application Priority Data

Jul. 16, 2003 (KR) ..... 10-2003-0048911
Jul. 16, 2003 (KR) ..... 10-2003-0048913

(51) Int. Cl.
*F23M 7/00* (2006.01)
*E05C 3/06* (2006.01)

(52) U.S. Cl. ..... 126/197; 219/724; 292/201

(58) Field of Classification Search ..... 126/197; 219/724, 739; 292/137, 144, 340, 341.15, 292/341.16, 341.18, 341.19, 201, 197, 203, 292/207, DIG. 69
See application file for complete search history.

(56) References Cited

U.S. PATENT DOCUMENTS 3,715,554 A * 2/1973 Umezu et al. ..... 219/724
3,889,654 A * 6/1975 Kauranen et al. ..... 126/194
4,082,077 A * 4/1978 Marfatia et al. ..... 126/197

(Continued)

*Primary Examiner*—Alfred Basichas
(74) *Attorney, Agent, or Firm*—Birch, Stewart, Kolasch & Birch, LLP

(57) ABSTRACT

A door opening and closing system for a electric oven is provided. The system includes: at least one latch provided at one side surface of a door; a door interlocking structure having a rotary lever, a switch and an elastic spring to sense opening and closing of the door, the rotary lever being pushed by the latch to rotate about one side, the switch sequentially contacting with the rotary lever, and the elastic spring allowing the rotary lever to be supported in one direction; and a door locking structure having a motor, a rotary unit and a latch guide unit, the motor rotating after it is sensed that the door is closed by the door interlocking structure, the rotary unit engaged with and rotated about a rotary shaft of the motor, and the latch guide unit being associated with the rotary unit to change a rotation motion of the rotary unit into a straight-line motion such that the door is latched to the latch to prevent an erroneous opening of the door.

27 Claims, 10 Drawing Sheets

U.S. PATENT DOCUMENTS 4,351,288 A 9/1982 Gasloli
4,374,320 A 2/1983 Barnett
4,511,780 A * 4/1985 Okamura ..... 219/724
4,593,945 A 6/1986 Arute et al.
4,663,505 A * 5/1987 Drake ..... 219/722
4,672,160 A * 6/1987 Katoh ..... 219/724
4,755,647 A * 7/1988 Nishikawa et al. ..... 219/724
4,927,996 A 5/1990 Genbauffe et al.
4,982,063 A * 1/1991 Tsunekawa et al. ..... 219/723
6,315,336 B1 * 11/2001 Swartzell ..... 292/201
6,852,961 B2 * 2/2005 Kawai ..... 219/722

* cited by examiner

DOOR OPENING AND CLOSING SYSTEM IN ELECTRIC OVEN

TECHNICAL FIELD

The present invention relates to a door opening and closing system for an electric oven, and more particularly, to a door opening and closing system for a electric oven in which a door opening and closing operation can be accurately indicated, and when a door is locked, a cavity can be safely shielded.

Further, the present invention relates to a door opening and closing system for a oven in which when the oven is erroneously used, it stops its operation, thereby more safely using the oven.

BACKGROUND ART

Generally, a electric oven is an apparatus for heating and cooking food by an electric heater at a tray of within a cavity. The electric oven can perform functions of a grill and an oven by radiant heat of the electric heater or by a convectional hot blast caused by a convection fan. Additionally, in case where a magnetron is further provided, the magnetron irradiates microwave into the cavity to more promptly cook the food.

Generally, the electric oven has a door at a front thereof. The door performs an opening and closing operation up and down by a hinge provided at a lower side of the door. Additionally, a latch provided at an upper end of the door is inserted and latched in a latch insertion hole provided at a front surface of the electric oven. Accordingly, the door can be safely maintained in a closed state. Additionally, when the user opens the door, the latch is unlatched using a predetermined unit to allow the user to open the door. Further, a predetermined door switch is provided to sense the insertion of the latch into the latch insertion hole. In case where it is determined that the latch is inserted into the latch insertion hole, it is determined that the door is closed and the electric oven initiates its operation. In case where it is determined that the latch is not inserted into the latch insertion hole, the electric oven does not initiate its operation even though a start button is pressed.

Alternatively, the related-art electric oven has a drawback as follows.

First, there is a drawback in that when the user opens the door without recognizing that the internal of the cavity reaches a high temperature, he/she can get burned. In order to prevent this, U.S. Pat. No. 6,315,336 entitled "MOTORIZED SELF-CLEANING OVEN LATCH" has been disclosed. Since the U.S. patent has a drawback due to a complicated structure in that an actual embodiment is difficult and a manufacture cost is increased.

Second, in case where the user inserts a long stick into the latch insertion hole for fun, it can be erroneously sensed as if the door is closed. At this time, since the electric oven can be operated even without any manipulation, the user can get burned. Furthermore, there is also a drawback in that the indoor fire can be caused in case where the electric oven performs the above operations in an overheating state.

DISCLOSURE OF THE INVENTION

Accordingly, the present invention is directed to a door opening and closing system for a electric oven that substantially obviates one or more of the problems due to limitations and disadvantages of the related art.

An object of the present invention is to provide a door opening and closing system for a electric oven in which an accident can be prevented while the electric oven is used.

Another object of the present invention is to provide a door opening and closing system for a electric oven in which a reliable door opening and closing system is provided, thereby increasing a user's convenience much more.

A further another object of the present invention is to provide a door opening and closing system for a electric oven in which an endangerment of a user caused by a careless use is reduced or a danger of indoor fire caused by heat of the electric oven is reduced.

A still another object of the present invention is to provide a door opening and closing system for a electric oven in which it can be simplified in structure, thereby reducing a manufacture cost and enhancing a convenience in product application.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, there is provided a door opening and closing system for a electric oven, the system including: at least one latch provided at one side surface of a door; a door interlocking structure having a rotary lever, a switch and an elastic spring to sense opening and closing of the door, the rotary lever being pushed by the latch to rotate about one side, the switch sequentially contacting with the rotary lever, and the elastic spring allowing the rotary lever to be supported in one direction; and a door locking structure having a motor, a rotary unit and a latch guide unit, the motor rotating after it is sensed that the door is closed by the door interlocking structure, the rotary unit engaged with and rotated about a rotary shaft of the motor, and the latch guide unit being associated with the rotary unit to change a rotation motion of the rotary unit into a straight-line motion such that the door is latched to the latch to prevent an erroneous opening of the door.

According another aspect of the present invention, there is provided a door opening and closing system for a electric oven, the system including: a latch provided at one side surface of a door; a first door opening and closing structure having a motor, a rotary unit, and a latch guide unit, the motor rotating in both directions when the latch is inserted/released, the rotary unit being engaged to a rotary shaft of the motor to rotate at a predetermined angle, and the latch guide unit having one end inserted into the rotary unit at a predetermined position and the other end latched to the latch; and a second door opening and closing structure provided at a position adjacent to the latch to indicate an opening and closing state of the door.

According to a further another aspect of the present, invention, there is provided a door opening and closing system for a electric oven, the system including: a protrusion protruded from one side surface of a door; a second door opening and closing structure having a rotary lever, a switch, and an elastic member, the rotary lever rotating in contact with the protrusion when the door is closed, the switch sequentially contacting with the rotary lever to perform a plurality of switching operations when the rotary lever is rotated, the elastic member applying one-direction elastic force to the rotary lever to indicate a position of the rotary lever; and a first door opening and closing structure maintaining the door to be in a locking state after the door is closed by the second door opening and closing structure.

The inventive door opening and closing system has an effect in that since it can prevent a great disaster from being generated when the electric oven is erroneously operated, a safety is more increased in use.

In particular, since the inventive door opening and closing system can prevent the door from being opened due to a careless use when an internal of the cavity is at a high temperature, the safety is more increased in use.

Further, the inventive door opening and closing system has an advantage in that it prevents the door from being erroneously sensed as being closed due to the foreign substance, there is not a danger of indoor fire caused by high heat of the electric oven.

Furthermore, the inventive door opening and closing system has an advantage in that the door opening and closing system for the electric oven is simplified in structure to reduce a manufacture cost and more increase a product application in convenience.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Hereinafter, preferred embodiments of the present invention will be described in detail with reference to accompanying drawings.

Figure 1:
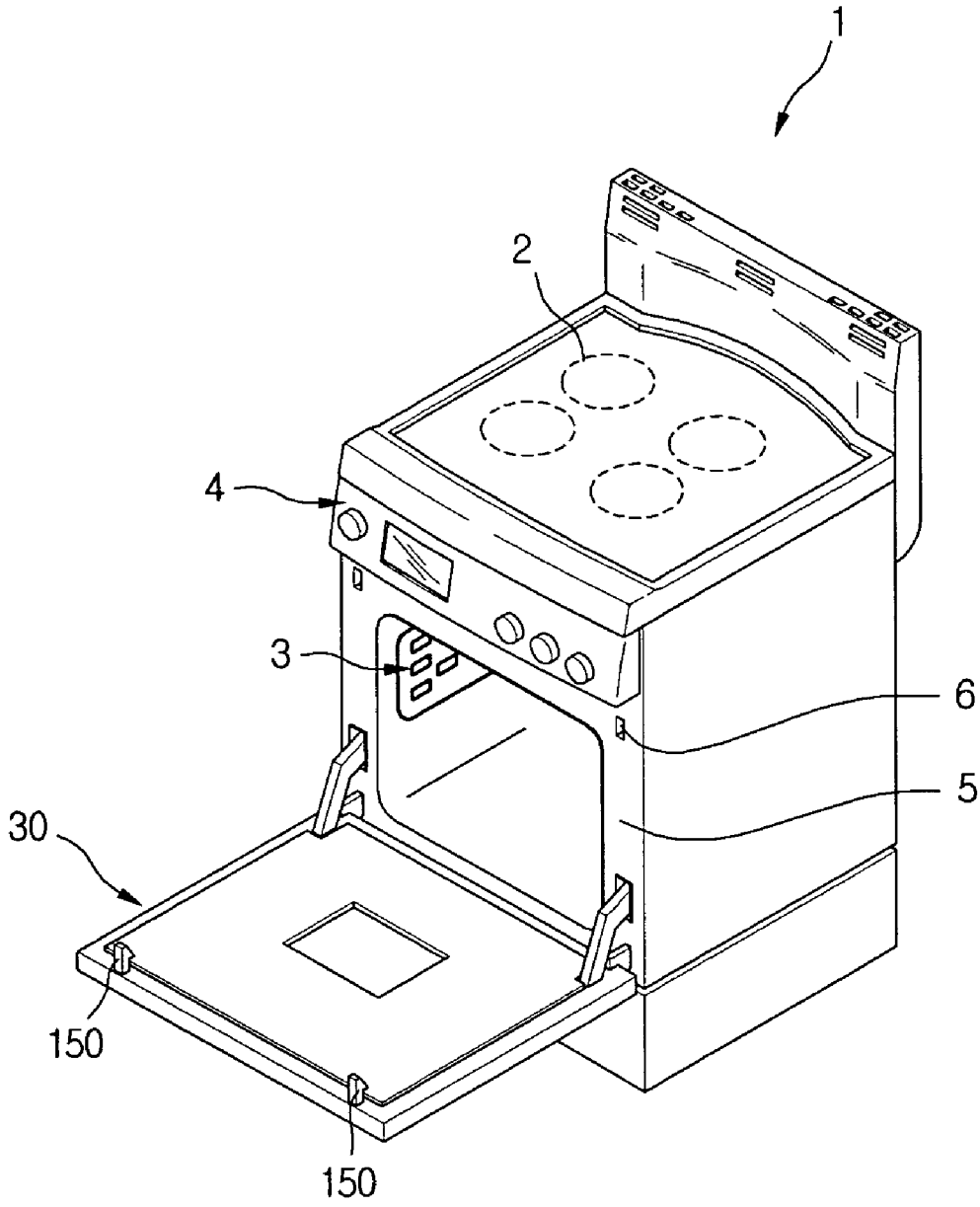
FIG. 1 is a perspective view illustrating a electric oven according to the present invention.

FIG. 1 is a perspective view illustrating a electric oven according to the present invention.

Referring to FIG. 1, the inventive electric oven 1 includes a cavity 3 having a heater; a door 30 selectively opened and closed at one surface of the cavity 3 to put food in and out the cavity; a latch 150 provided at one side of within the door 30; an insertion hole 6 provided at one side surface of a housing 5 to insert the latch 150, thereby fixing the door 30 to the housing 5.

An operation of a door opening and closing system of the electric oven according to the present invention is described in brief.

If a user seals the cavity 3 by the door 30, the latch 150 is inserted into the insertion hole 6. At this time, a first door opening and closing apparatus latches the latch 150 in the insertion hole 6. Additionally, when objects such as a spoon are erroneously inserted into the insertion hole 6, a second door opening and closing apparatus senses that the inserted object is not the door 30 and determines that the door is not in a closed state, thereby enhancing safety in use. The first door opening and closing apparatus is a door locking apparatus, and the second door opening and closing apparatus is an interlocking apparatus.

In detail, the interlocking apparatus is a structure for preventing, when the user inserts a stick into the insertion hole 6 for fun, a door switch in the insertion hole 6 from sensing as if the door is in the closed state. In case where it is sensed as if the stick inserted for fun is the door, thereby initiating an operation of the electric oven, there is a danger in safety such as indoor fire. Therefore, only when the latch 150 is exactly inserted, it should be determined that the door is in the closed state.

Alternatively, the inventive electric oven can also include a manipulation unit 4 provided at an upper side of the cavity to manipulate the operation of the electric oven; and a hot plate 2 provided at an upper side of the electric oven to put a cooker thereon and cook food. However, the electric oven having the cavity without the hot plate 2 can be used.

Figure 2:
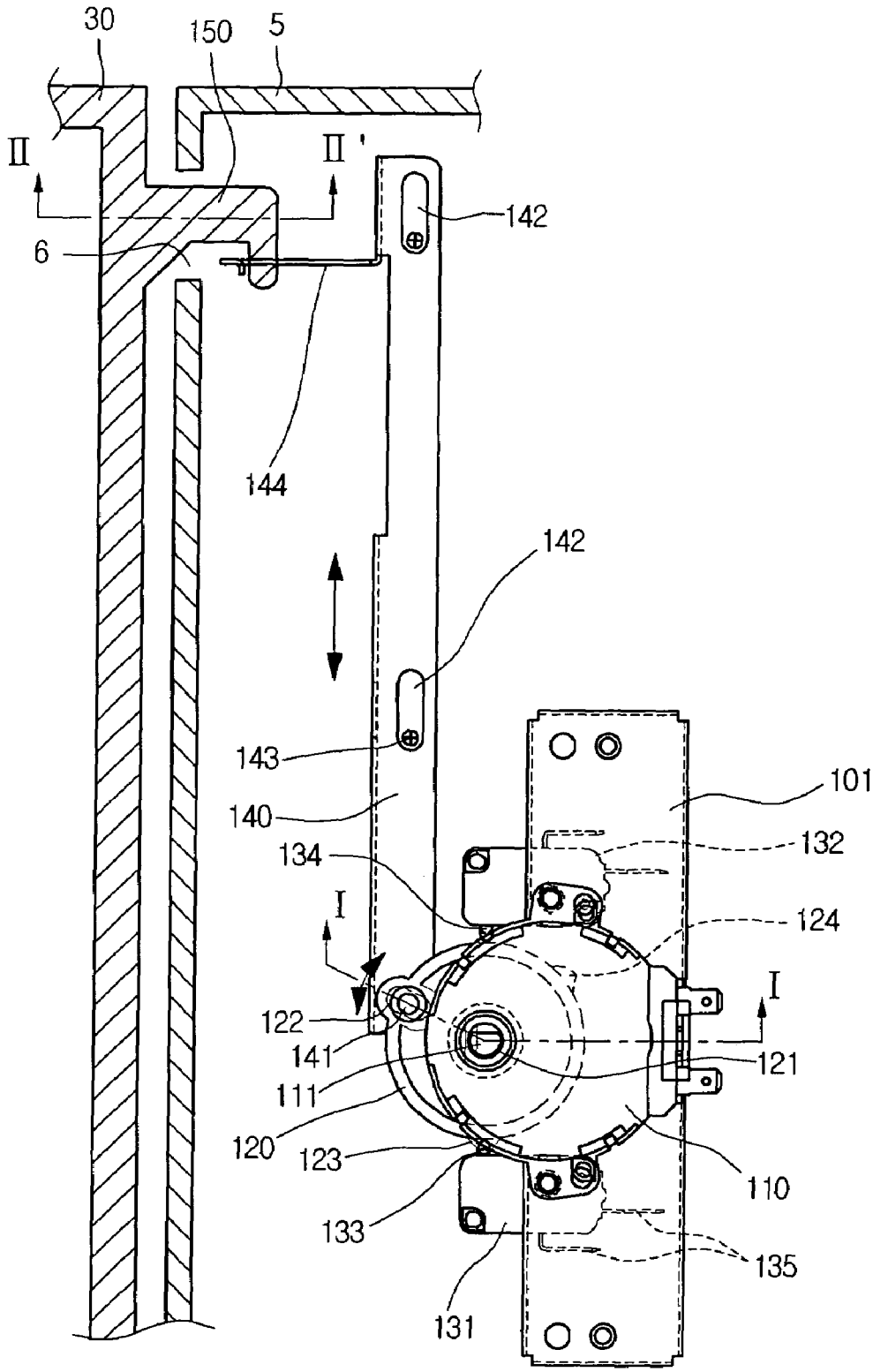
FIG. 2 is a plan view illustrating a first door opening and closing system according to the present invention.
Figure 3:
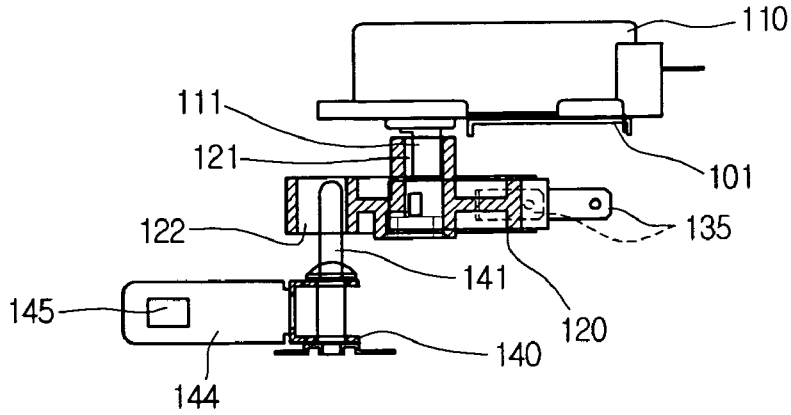
FIG. 3 is a sectional view taken along line I-I' of FIG. 2.

FIG. 2 is a plan view illustrating a first door opening and closing apparatus according to the present invention, and FIG. 3 is a sectional view taken along line I-I' of FIG. 2.

FIG. 2 illustrates the first door opening and closing apparatus, and can be understood when the latch 150 and the insertion hole 6 are horizontally observed.

Referring to FIGS. 2 and 3, the inventive first door opening and closing apparatus includes an upper plate 101 fixed to any one side of the housing 5; a motor 110 being seated on the upper plate 101 and rotating in a forward direction or in a reverse direction; a disc-shaped rotary unit 120 for rotating by a motor shaft 111 at a lower side of the upper plate 101; first and second contact protrusions 123 and 124 protruded from left and right peripheries of the rotary unit 120; first and second micro-switches 131 and 132 being switched on/off by the contact protrusions 123 and 124 when the rotary unit 120 is rotated; and a latch guide 140 being reciprocated according to a rotary motion of the rotary lever 120 to lock or unlock the door latch 150.

An operation of the inventive door opening and closing apparatus is described in brief. In order to completely lock the door in a state where the door is closed to insert the latch 150, the latch guide 140 is moved forth and back. If the latch guide 140 is moved to latch the latch 150, the door is locked. If the latch 150 is released, the door can be opened. If the latch 150 is latched using the latch guide 140 of the first door opening and closing apparatus, the door is not opened even though a user pulls the door. If the latch 150 is released using the latch guide 140 of the first door opening and closing apparatus, the user can pull and open the door.

In detail, the motor 110 is seated and fixed to the upper plate 101. Additionally, the motor shaft 111 extended from a lower side of the motor 110 is inserted into a shaft insertion hole 121. The shaft insertion hole 121 is provided at a center of the disc-shaped rotary unit 120. The disc-shaped rotary unit 120 is provided at a lower side of the motor shaft 111. Here, the disc-shaped rotary unit 120 has a guide shaft hole 122 at a circumference thereof, and has the first and second contact protrusions 123 and 124 protruded from a periphery thereof. Further, the rotary unit 120 has the guide shaft hole 122 and the contact protrusions 123 and 124, which are disposed at an interval of 120°. The motor shaft 111 and the shaft insertion hole 121 have noncircular-shapes to allow a rotary force of the motor 110 to be transmitted without sliding.

As an example, the motor 110 and the rotary lever 120 can be also arrayed in a horizontal direction, not in a layered structure, to transmit a driving force, and can also employ other apparatuses.

Further, the first and second micro-switches 131 and 132 are installed adjacently to and outside the rotary unit 120. The first and second micro-switches 131 and 132 respectively have first and second switch contacts 133 and 134, which contact with the contact protrusions 123 and 124, to be disposed within a rotation radius of the first and second contact protrusions 123 and 124. As an example, the micro-switches 131 and 132 and the contact protrusions 123 and 124 can be correspondingly changed in position.

Furthermore, the guide shaft 141 upwardly protruded from one end of the horizontally disposed latch guide 140 is inserted into the guide shaft hole 122 of the rotary unit 120. Accordingly, the guide shaft hole 122 guides the guide shaft 141 to allow the latch guide 140 to reciprocate with respect to a circular motion of the rotary unit 120. For this, the guide shaft hole 122 is provided to have a relatively long and straight-line shape such that the guide shaft 141 can move within a predetermined range. Additionally, the latch guide 140 has at least one latch guide slot 142. The latch guide 140 is guided within a range of a straight-line motion along a fixing guide member, such as a screw 143, which is engaged to the latch guide slot 142. Additionally, the door latch 150 is protruded from the other end of the latch guide 140 in an orthogonal direction. A latch through-hole 145 is provided at a center of the latch hooking unit 144 to lock the latch 150. As an example, the latch hooking unit 144 can have an "L"-shape, and can be changed in shape as far as the latch 150 can be locked and unlocked.

An operation of the door opening and closing apparatus is described.

If a predetermined sensing apparatus senses that the door is closed and the latch 150 is inserted into the insertion hole 6, the motor 110 rotates to allow a clockwise rotation of the rotary unit 120. If the rotary unit 120 rotates, the latch guide 140 is pushed up to fit the latch 150 into the latch through-hole 145, thereby fixing the latch 150. Additionally, the first switch contact 133 can be pushed by the first contact 123 to terminate the rotary motion of the motor 110. In this case, pyrolysis operation may be performed to maintain the cavity clean. Alternatively, when the door is attempted for opening, the motor 110 is rotated in an opposite direction of the above operation.

In detail, locking and unlocking states of the inventive door opening and closing apparatus are described with reference to FIGS. 4 and 5.

Figure 4:
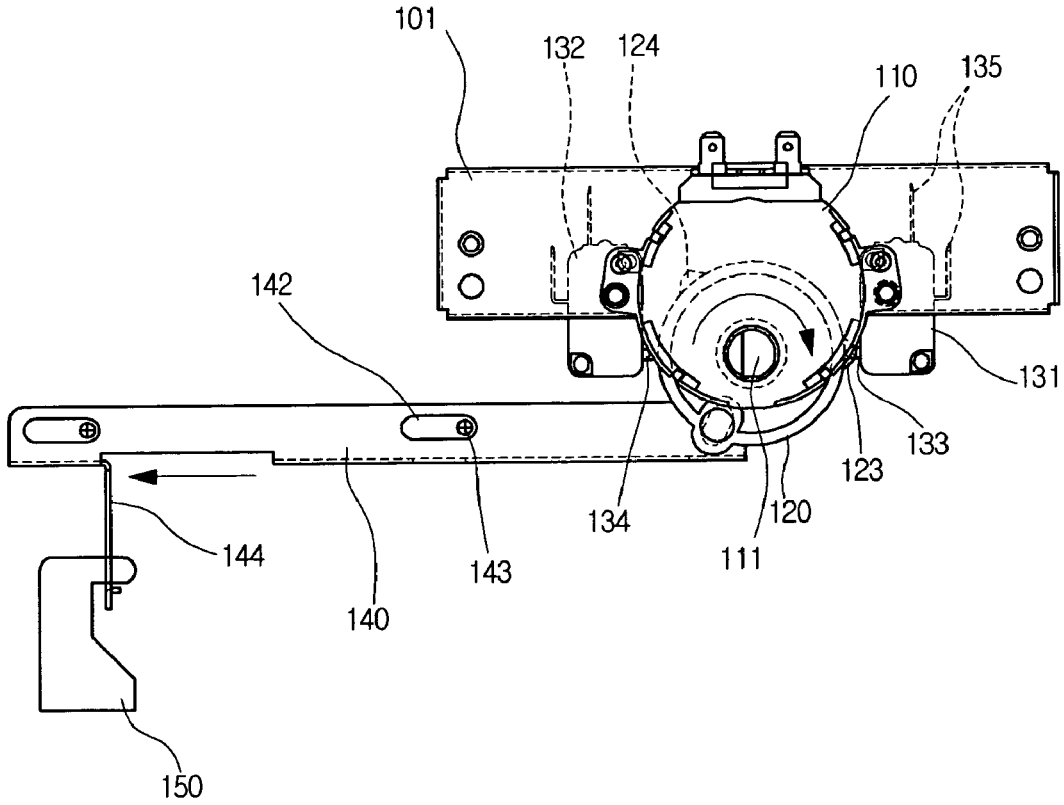
FIG. 4 is a view illustrating a locking state of a first door opening and closing system according to the present invention.

FIG. 4 is a view illustrating an operation of the unlocking state of the door. If the door is closed, the door switch senses the locking of the door to supply a power to the motor depending on a key signal of a controlling unit. Accordingly, the motor shaft 111 is rotated in a predetermined direction, and the rotary unit 120 is engaged at its center to the motor shaft 111 to rotate clockwise. If the rotary unit 120 is rotated clockwise, the first contact protrusion 123 of the rotary unit 120 presses, at its right side, the first switch contact 133 of the first micro-switch 131 to perform a switch-on. At the same time, the clockwise rotation of the rotary unit 120 causes the latch guide 140 to perform a straight-line motion to the right. The latch guide 140 has the guide shaft 141 inserted into the guide shaft hole 122 of the rotary unit 120. The first switch contact 133 is switched on to cut off the power supplied to the motor and terminate the operation. At this time, the door latch 150 is fitted and latched in the through-hole 145 of the latch hooking unit 144, which is protruded from the other end of the latch guide 140, to allow the door to be in the locking state.

Figure 5:
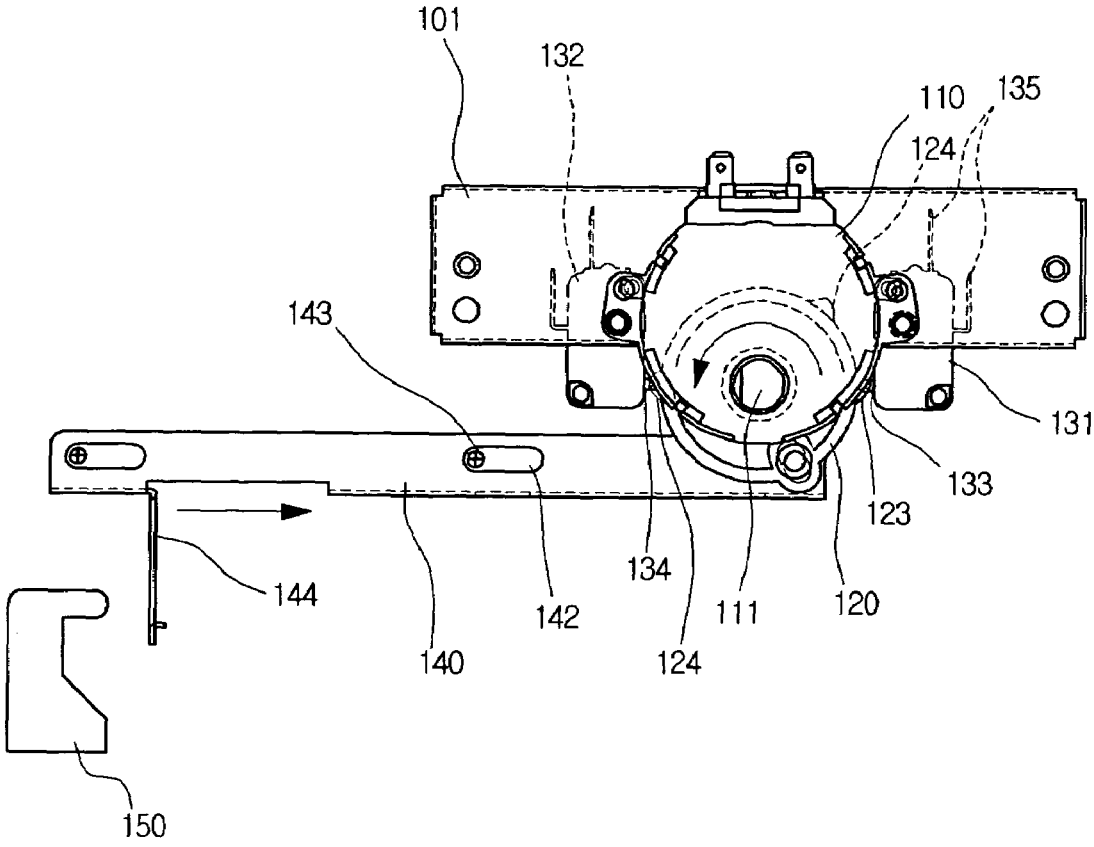
FIG. 5 is a view illustrating an unlocking state of a first door opening and closing system according to the present invention.

FIG. 5 is a view illustrating the unlocking state of the first door opening and closing apparatus according to the present invention.

When the door is attempted for opening, the motor shaft 111 rotates counterclockwise. If the rotary unit 120 is rotated counterclockwise, the second contact protrusion 124 of the rotary unit 120 presses the second switch contact 134 of the second micro-switch 132 to perform the switching. Additionally, as the rotary unit 120 rotates counterclockwise, the latch guide 140 is pulled downward along the screw 143 fitted into the guide slot 142 to perform the straight-line motion, and the door latch 150 is released from the latch through-hole 145 provided at the other end of the latch hooking unit 144. The second switch contact 132 can be also pressed by the second contact protrusion 124 to switch off the power supplied to the motor.

As such, the protrusions 123 and 124 are provided at the left and right sides of the disc-shaped rotary unit 120 performing the rotary motion. The rotary force of the motor 110 and an on/off operation contacting of the first and second micro-switches 131 and 132 are sensed. Accordingly, the door latch can be stably operated. In other words, the door is stably locked and unlocked such that when the electric oven performs any operation such as pyrolysis, thereby generating a high heat, a user's safety can be more improved.

The door opening and closing apparatus is an apparatus for preventing the opening of the door to enhance the user's safety. Alternatively, the opening or closing of the door should be reliably sensed to operate the door opening and closing apparatus. An interlocking apparatus of the door is provided as an apparatus for meeting the above requirement. Hereinafter, the interlocking apparatus is described.

Figure 6:
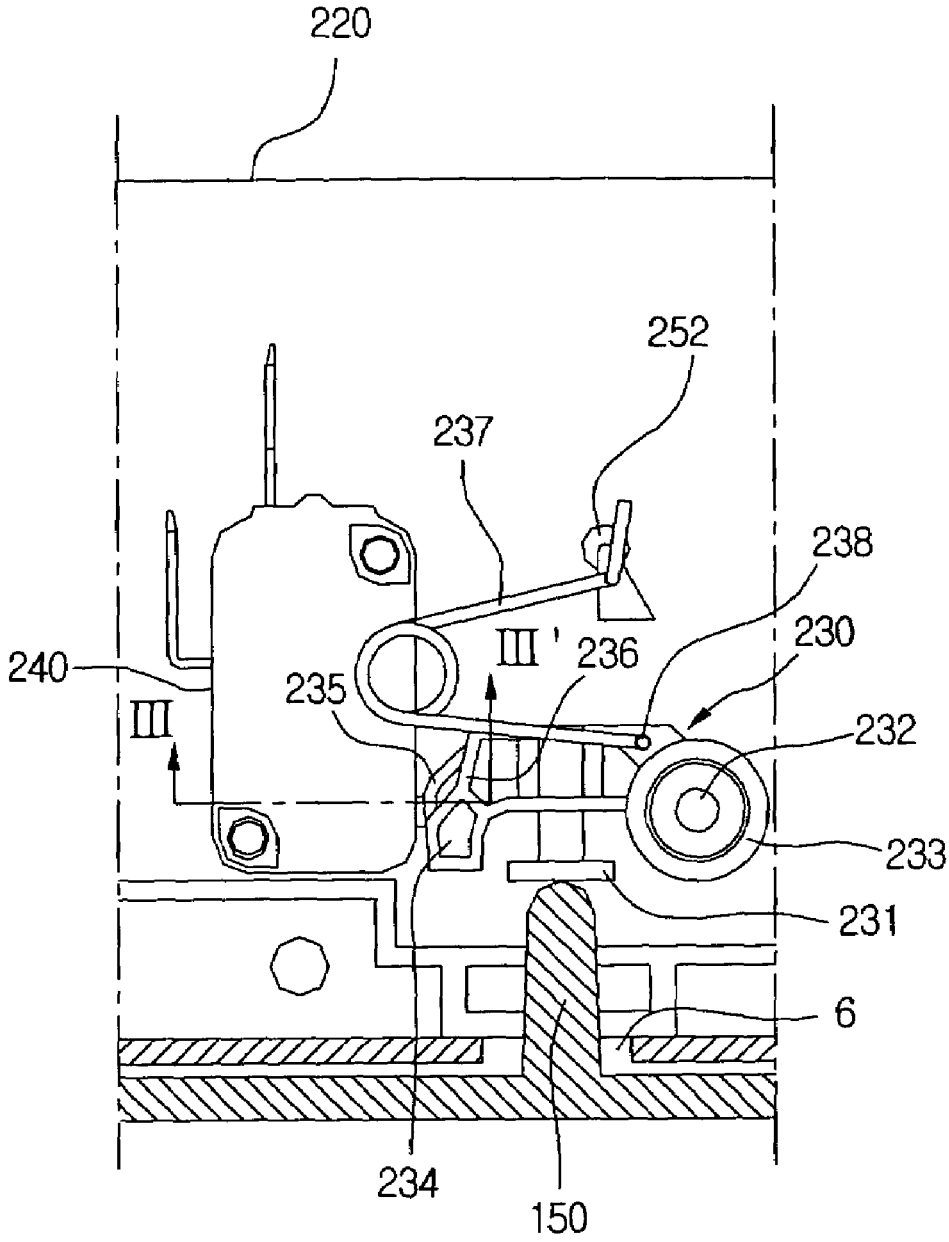
FIG. 6 is a sectional view taken along line II-II' of FIG. 2.

FIG. 6 is a sectional view taken along line II-II' of FIG. 2, and illustrates the interlocking apparatus of the door as the second door opening and closing apparatus. A position and/or a place where the interlocking apparatus is installed can be changed unlike the disclosed embodiment.

Figure 7:
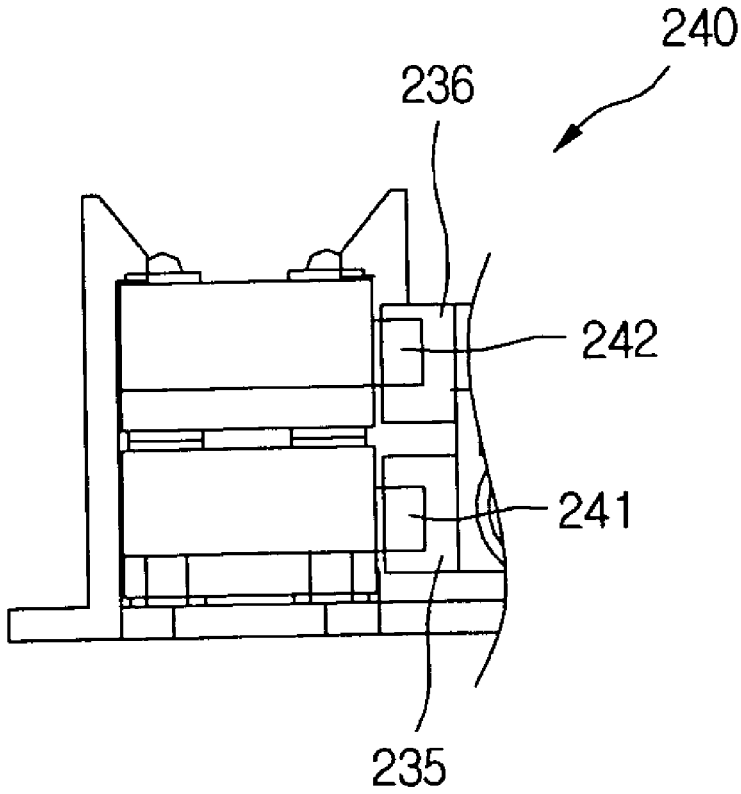
FIG. 7 is a sectional view taken along line III-III' of FIG. 6.

Referring to FIG. 6, the interlocking apparatus includes the latch 150 latched to the door; a latch board 220 fixed to any position of the housing 5; a rotary lever 230 being rotated, in contact with the door latch 150, depending on the opening and closing of the door, and having step switches 235 and 236 at ends thereof; the micro-switch 240 having a plurality of switch contacts for performing an on/off operation depending on the rotary lever 230; and an elastic spring 237 providing a predetermined elastic repulsive force with respect to the rotation of the rotary lever 230. The micro-switch 240 can also employ a plurality of layered micro-switches and a single micro-switch having two contacts. However, it is enough only that contact switches are provided at two vertically spaced-apart positions. The latch 150 can be also inserted into the insertion hole 6. FIG. 7 is a sectional view taken along line III-III' of FIG. 6. In FIG. 7, a separate micro-switch 240 is comprised of a monitor switch contact 241 and a primary switch contact 242 that are layered up and down.

Alternatively, the latch 150 can employ a latch having a function of locking the door, but can also employ a separate protrusion being provided at an inner side surface of the door and opposing to a position at which the interlocking apparatus is installed.

An operation of the interlocking apparatus is described in brief.

The door latch 150 latched with the door pushes the rotary lever 230. The rotary lever 230 rotates about a predetermined center to sequentially operate the monitor switch contact 241 and the primary switch contact 242, which are provided at the micro-switch 240. While this operation causes the closing of the door, the monitor switch contact 241 and the primary switch contact 242 are sequentially operated in a serial process. By this sequential operation, the closing of the door can be sensed. When the object such as a dinnerware is put in the electric oven, the interlocking apparatus determines that the object is not the door, thereby preventing the object from being erroneously sensed as if the object is the door.

A detailed construction and an operation or effect relating with the detailed construction of the interlocking apparatus are described with reference to the above construction.

If the door is closed, the latch 150 is inserted into the insertion hole 6 to push the rotary lever 230 such that the rotary lever 230 rotates about the rotary shaft 232. A rotary guide protrusion 231 is engaged to an approximate center of the rotary lever 230. Therefore, if the latch 150 is inserted, it contacts with the rotary guide protrusion 231 to wholly push the rotary lever 230.

Additionally, if the rotary lever 230 is rotated, the first and second step switches 235 and 236 of the step protrusion 234, which is provided at a front end of the rotary lever 230, sequentially operate the monitor switch contact 241 and the primary switch contact 242 of the micro-switch 240, which are vertically disposed. In detail, since the first and second step switches 235 and 236 are stepped up and down, the first step switch 235 pushes the monitor switch contact 241 to perform the switching. The second step switch 236 pushes the primary switch contact 242 to perform the switching. Additionally, only in case where the monitor switch contact 241 and the primary switch contact 242 are sequentially switched on/off at a predetermined time interval, it is sensed that the switching is performed using the latch 150, to determine whether or not the door is normally opened and closed.

Figure 8:
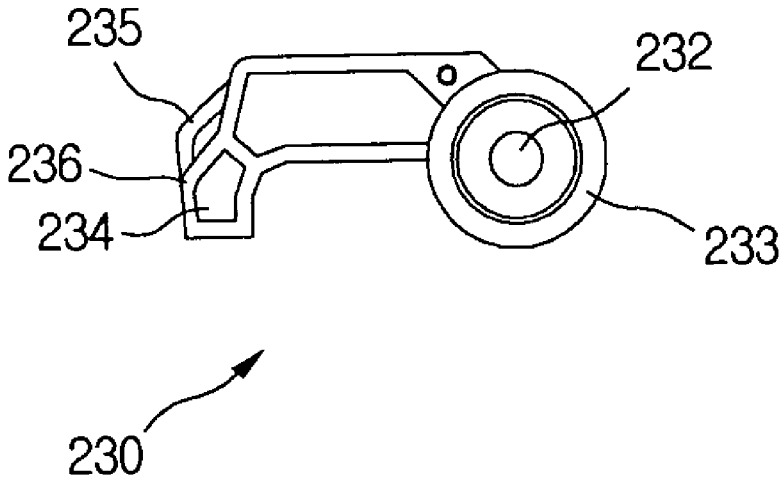
FIG. 8 is a plan view illustrating a rotary lever of a second door opening and closing system according to the present invention.

FIG. 7 is a section view taken along III-III' of FIG. 6, and FIG. 8 is a plan view illustrating the rotary lever.

Referring to FIGS. 7 and 8, the primary switch contact 242 and the monitor switch contact 241 are provided to have different heights at one side surface of the micro-switch 240. Additionally, the step protrusion 234 provided at one end of the rotary lever 230 is comprised of the first step switch 235 and the second step switch 236 that are protrusively stepped in two rows. The first step switch 235 faces with the monitor switch contact 241 to perform the switching. The second step switch 236 faces with the primary switch contact 242 to perform the switching. Therefore, the plurality of switch contacts 241 and 242 pushes the switch contacts 241 and 242 within the rotation radiuses of the first and second step switches 235 and 236 to perform the switching.

In detail, in a state where the rotary lever 220 is rotatable about the rotary shaft 111, the rotary lever 220 is engaged at one side to the rotary guide protrusion 231 and is pressed at the other side by the elastic repulsive force of the elastic spring 237. In this state, when the door is closed, the door latch 150 pushes the rotary guide protrusion 231. At this time, the rotary lever 230 is rotated about the rotary shaft 232 together. The elastic repulsive force of the elastic spring 237 is also acted. Additionally, when the rotary lever 230 rotates, the first step switch 235 provided at a front end of the step protrusion 234 presses the primary switch contact 241 of the micro-switch 240 to perform the switching. After a predetermined time, the second step switch 236 presses the monitor switch contact 242 of the micro-switch 240 to perform the switching. At this time, the monitor switch 240 is operated at a time point when the primary switch and the monitor switch are concurrently switched on. Further, only in case where the primary switch and the monitor switch are switched on at a predetermined time interval, it can be recognized that the door is closed. In case where the switch is operated due to the introduction of the foreign substance, the switch is not switched off at a predetermined sequence or at the time interval. Accordingly, it is determined that the door is not closed such that the operation of the electric oven is prevented.

A non-described numeral 233 denotes a boss fixed to one end of the rotary lever 230. A non-described numeral 252 denotes a boss fixed to one end of the elastic spring 237. A non-described numeral 238 denotes a fixing unit fixed to the other end of the elastic spring 237.

FIGS. 9 to 12 are views illustrating a sequential latch-inserting operation of the second door opening and closing apparatus.

Figure 9:
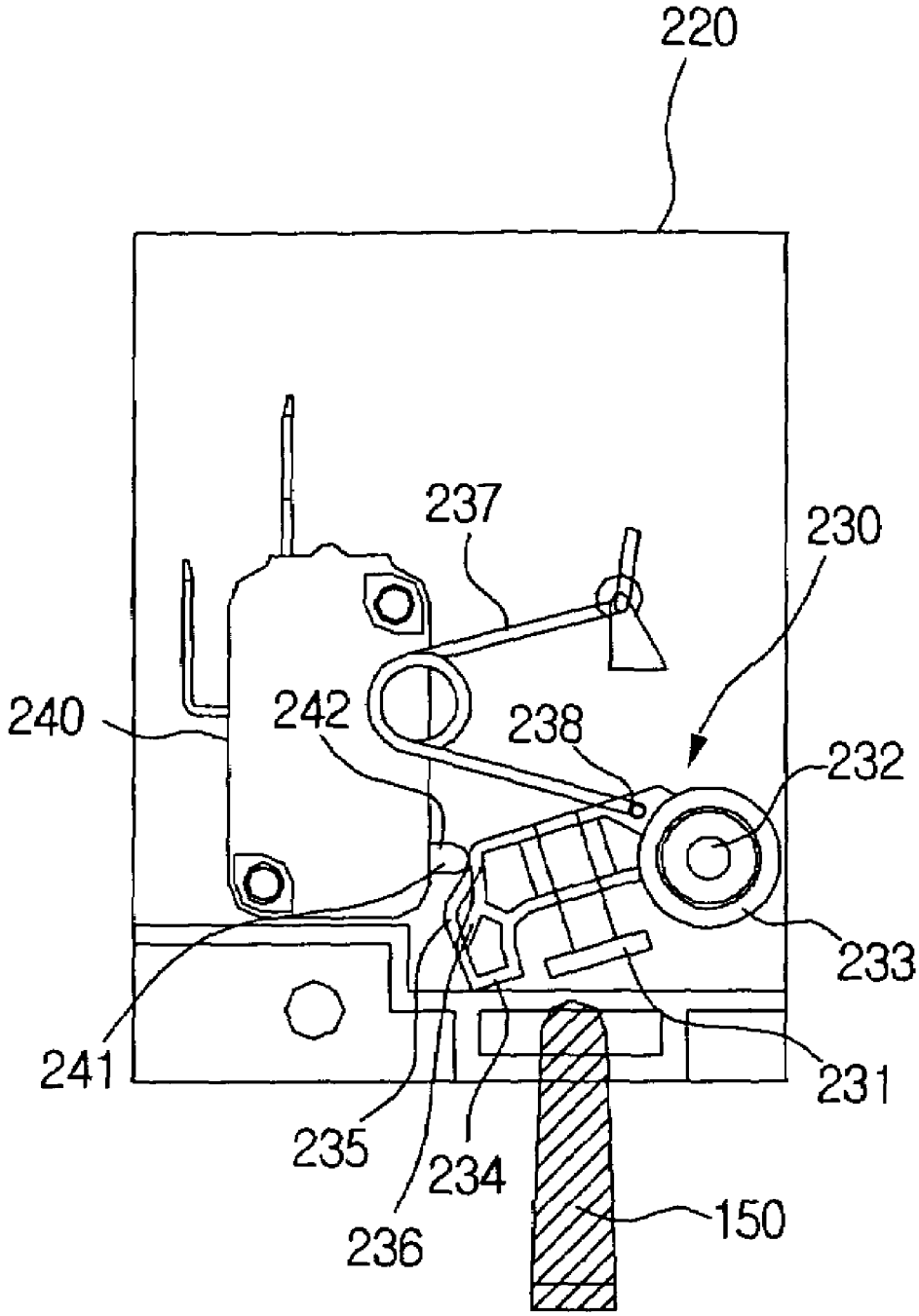
FIGS. 9 to 12 are views illustrating a sequential latch-inserting operation of a second door opening and closing system according to the present invention.

In an initial state where the latch is inserted, as in FIG. 9, the monitor switch contact 241 and the primary switch contact 242 of the micro-switch are switched-off and the door is opened.

Figure 10:
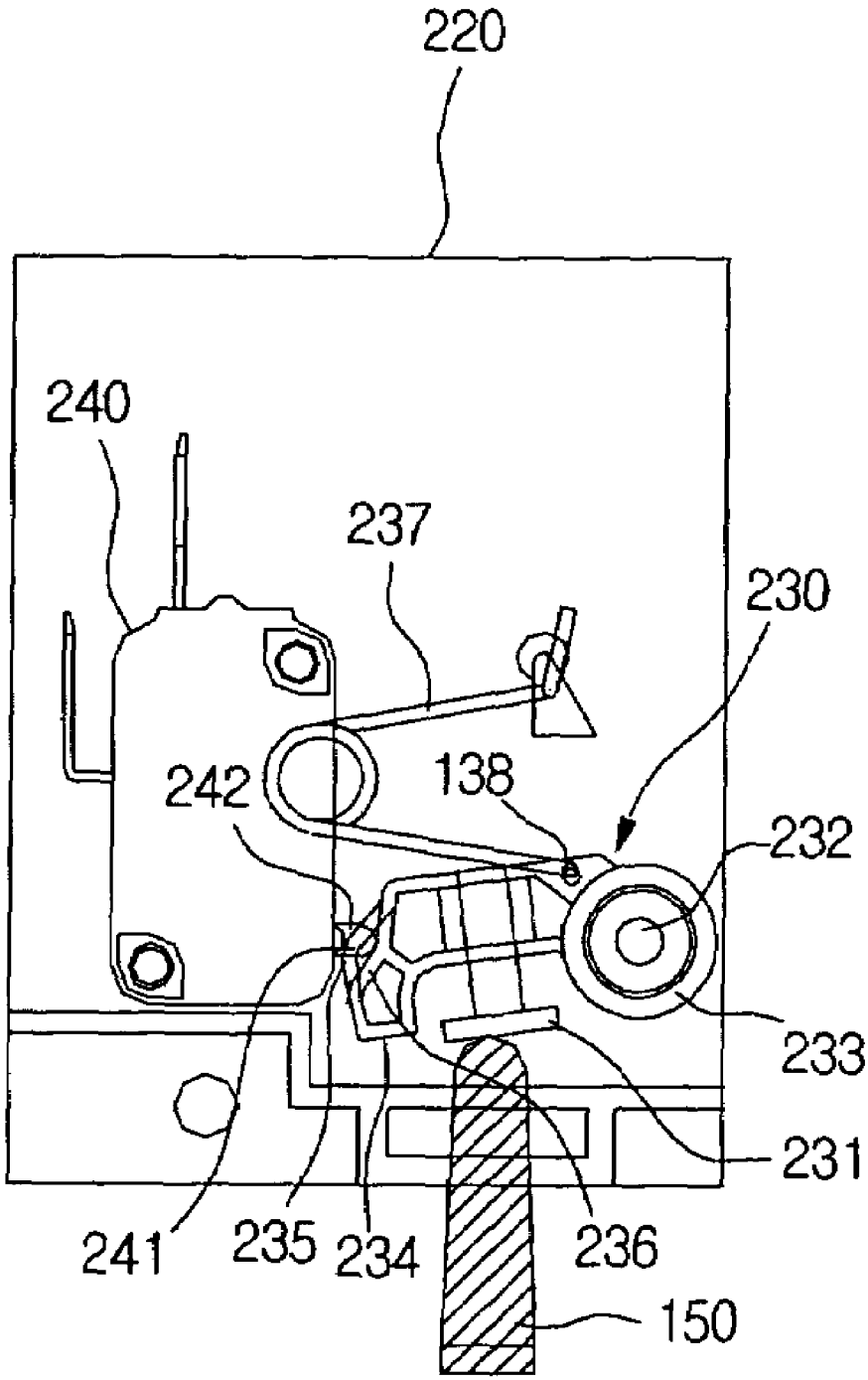

FIG. 10 illustrates a state where the latch 150 is gradually moved forth as the door is closed. The latch 150 pushes the rotary guide protrusion 231 while the rotary lever 230 begins to rotate. At this time, the first step switch 235, which is provided at the step protrusion 234 of the rotary lever 230, presses the monitor switch contact 241 such that the monitor switch is changed to be in a switching-on state. However, the primary switch contact 242 is maintained to be in the off state such that it can be easily determined that the door is not fully closed.

Figure 11:
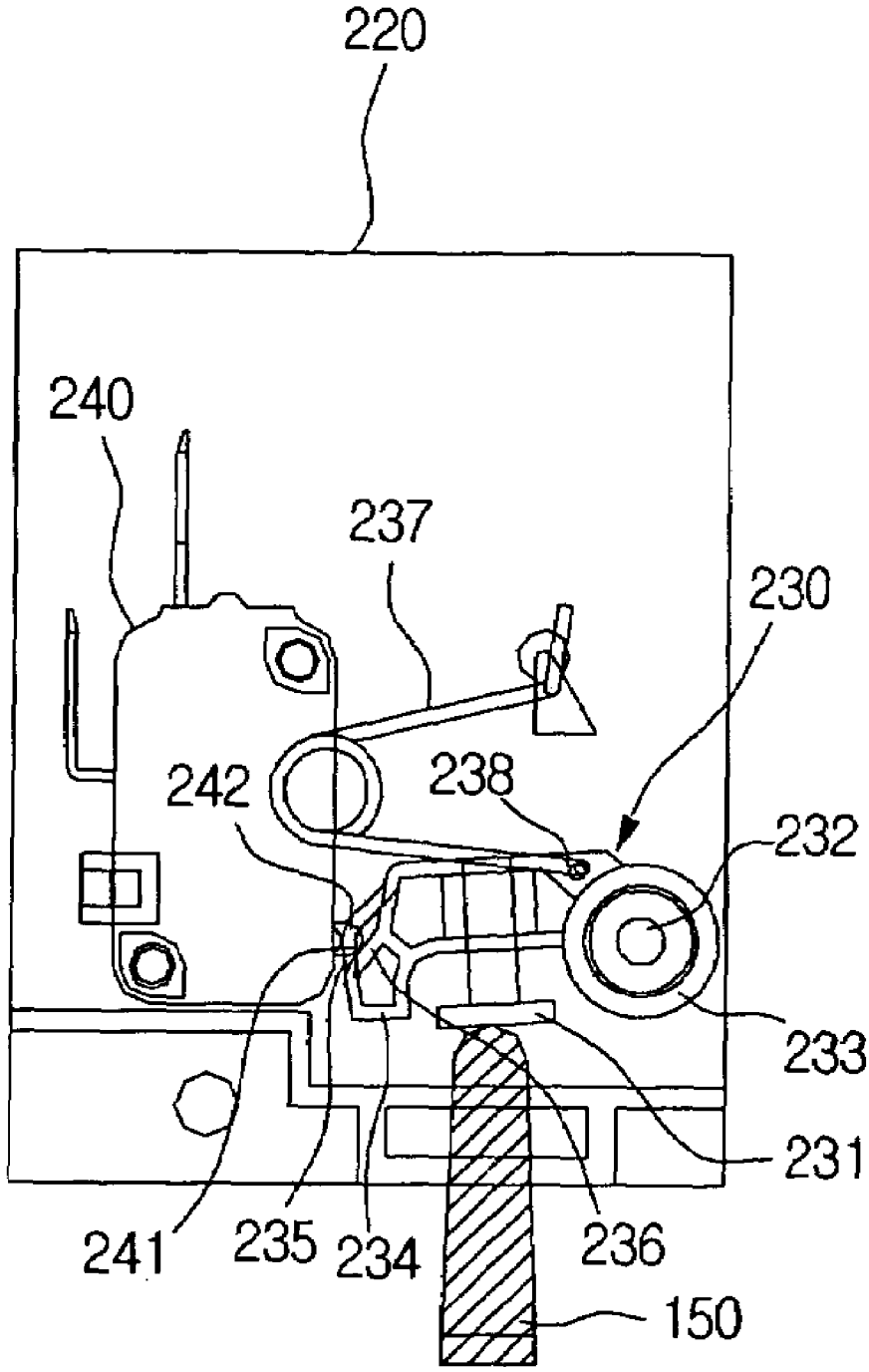

FIG. 11 illustrates a state where the latch 150 is moved a little more forth. The latch 150 pushes the rotary guide protrusion 231 while the rotary lever 230 is pushed a little more than FIG. 10. At this time, the second step switch 236 provided at the step protrusion 234 of the rotary lever 230 presses the primary switch contact 242 to change the primary switch contact to be in the switch-on state. The monitor switch contact 241 is continuously maintained to be in the switch-on state.

Figure 12:
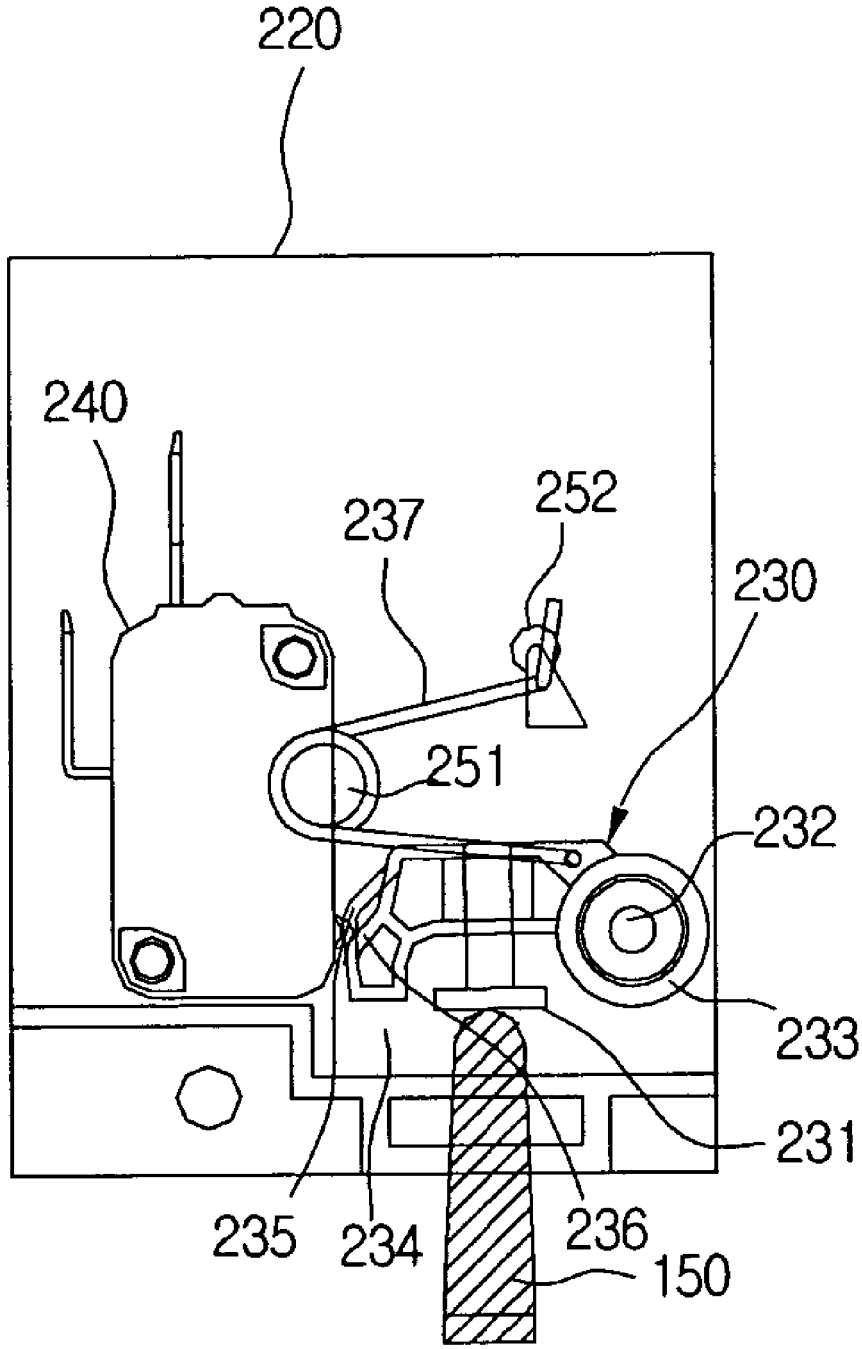

FIG. 12 illustrates a state where the monitor and primary switch contacts 241 and 242 of the micro-switch are in the switch-on states, and the door latch 150 is fully latched. Therefore, a general operation of the electric oven, which should be initiated after the door is closed, can be initiated. Alternatively, in case where the door is not sequentially closed at a time interval or one switch is not switched-on as in FIGS. 9 to 12, it is determined by the switching-on of the monitor switch contact 241 and the primary switch contact 242 that the door is not closed, thereby not initiating the operation of the electric oven. By doing so, the user can use the electric oven under more improved safety.

Alternatively, as the rotary lever rotates clockwise, the elastic spring has a greater elastic repulsive force. Accordingly, the elastic spring can be easily restored in an original state. Therefore, when the door is opened, the rotary lever 230 is pushed by the repulsive force of the elastic spring 237 such that the micro-switch 240 can be switched-off. At this time, it can be also sensed that the door is opened.

Further, when the monitor switch contact 241 and the primary switch contact 242 are all switched-on, it can be determined that the door is fully closed. Accordingly, the electric oven can initiate the normal operation, and the door locking apparatus described as the first door opening and closing apparatus can operate.

The door opening and closing apparatus according to the present invention concurrently embodies the first door opening and closing apparatus, and the second door opening and closing apparatus. The first door opening and closing apparatus is provided as the door locking apparatus to lock the door, thereby preventing the opening of the door. The second door opening and closing apparatus is provided as the door interlocking apparatus to accurately indicate the opening and closing of the door. Only in case where it is sensed that the door is fully closed by the second door opening and closing apparatus, the first door opening and closing apparatus can be operated. However, any one door opening and closing apparatus can be selectively employed depending on a detailed application for the electric oven. In detail, the first door opening and closing apparatus is mounted to safely operate the electric oven with the door not being opened. The second door opening and closing apparatus is provided to prevent the operation of the electric oven in a dangerous state caused by a user's unconscious action. However, in case where the first door opening and closing apparatus and the second door opening and closing apparatus are all used, a total scope of the present invention can be safely embodied.

Further, the first and second door opening and closing apparatuses perform the opening and closing operation by a single latch latched with the door, but can perform separate operations by each of latches. At this time, the first door opening and closing apparatus can be a certain apparatus for performing the reliably locking of the door, and the second door opening and closing apparatus can be a certain apparatus for preventing the foreign substance from being recognized as the door.

INDUSTRIAL APPLICABILITY

As described above, the inventive door opening and closing apparatus has an effect in that when the electric oven is erroneously operated, the apparatus can prevent a great disaster, thereby more increasing a safety in use.

In particular, the inventive door opening and closing apparatus has an effect in that when the internal of the cavity reaches a high temperature, the apparatus can prevent the opening of the door caused by a careless use, thereby much more increasing the safety in use.

Further, the inventive door opening and closing apparatus has an advantage in that it prevents the door from being erroneously sensed as if the door is closed due to the foreign substance, a danger of indoor fire is not caused by high heat of the electric oven.

Furthermore, the inventive door opening and closing apparatus has an advantage in that the apparatus is simplified in structure to reduce a manufacture cost and more increase a product application in convenience.

The invention claimed is:

1. A door opening and closing system in an electric oven, the system comprising:

at least one latch provided at one side of a door;

a door interlocking structure including:

a switch; and a rotary lever being rotated by the at least one latch at a first side of the rotary lever when the door is moved from an open position to a closed position, the rotary lever having a first engagement portion and a second engagement portion at a second side of the rotary lever opposite the first side, the first engagement portion and second engagement portion coming in contact in seriatim with the switch unit as the rotary lever is rotated to indicate when the door is in the open position, an intermediate position between the open position and the closed position, and the closed position; and a door locking structure including:

a motor having a rotary shaft;

a rotary unit; and a latch guide, wherein the rotary shaft is rotated by the motor when the door interlocking structure indicates that the door is closed, the rotary unit is rotated by the rotary shaft of the motor, and the latch guide cooperates with the rotary unit to change a rotation motion of the rotary unit into a straight-line motion of the latch guide such that the latch guide contacts the at least one latch to prevent opening of the door.

2. The system according to claim 1, wherein the rotary shaft has a noncircular cross-section and is inserted into the rotary unit.

3. The system according to claim 1, further comprising:

at least one contact protrusion provided at a predetermined position on the rotary unit; and at least one micro-switch provided at a corresponding position of the contact protrusion to indicate a motion position of the latch guide.

4. The system according to claim 1, further comprising:

a guide shaft extending from one side of the latch guide; and a guide shaft hole provided at the rotary unit to receive the guide shaft therein.

5. The system according to claim 1, wherein the motor, the rotary unit and the latch guide are provided in a layered arrangement.

6. The system according to claim 1, wherein the latch guide includes a latch hooking unit bent and angled with respect to a length direction of the latch guide at an end of the latch guide opposite the rotary unit.

7. The system according to claim 1, wherein the latch guide includes a latch guide slot to receive a protrusion to guide the straight-line motion of the latch guide.

8. The system according to claim 1, wherein the rotary lever includes a rotary guide protrusion extending from the rotary lever toward the at least one latch such that the at least one latch pushes the rotary guide protrusion when the at least one latch rotates the rotary lever.

9. The system according to claim 1, wherein the first engagement portion and second engagement portion are arranged in a stepped relationship.

10. The system according to claim 9, wherein the switch unit includes two switch contacts arranged to be contacted in seriatim by the first and second engagement portions.

11. The system according to claim 1, wherein the switch unit includes two switch contacts arranged to be contacted in seriatim by the first and second engagement portions.

12. The system according to claim 1, wherein the switch unit includes two layered micro-switches.

13. The system according to claim 1, wherein the door interlocking structure includes an elastic spring to assist the rotation of the rotary lever in a direction opposite to an insertion direction of the at least one latch.

14. A door opening and closing system in an electric oven, the system comprising:

at least one latch provided at one side of a door;

a first door opening and closing structure including:

a motor having a rotary shaft;

a rotary unit; and a latch guide, wherein the rotary shaft is rotated by the motor in a first direction when the at least one latch is inserted, and is rotated by the motor in a second direction opposite the first direction when the at least one latch is removed, the rotary unit being rotated by the rotary shaft of the motor to rotate through a predetermined angle, and the latch guide having one end connected to the rotary unit and the other end being latchable by the at least one latch when the at least one latch is inserted such that the latch guide contacts the at least one latch to prevent an opening of the door; and a second door opening and closing structure provided at a position adjacent to the at least one latch to indicate an opening and closing state of the door by contact of the at least one latch with the second door opening and closing structure.

15. The system according to claim 14, further comprising:

at least one protrusion provided at a circumference of the rotary unit; and at least one micro-switch provided at a corresponding position of the protrusion to sense a rotation degree of the rotary unit by using a displacement of the protrusion.

16. The system according to claim 14, wherein the latch guide contacts the at least one latch after the second door opening and closing structure indicates that the door is in the closed state.

17. The system according to claim 14, wherein the latch guide contacts the at least one latch when the electric oven performs a pyrolysis operation.

18. The system according to claim 14, wherein the rotary unit is connected to the latch guide by a guide shaft, and the guide shaft and the rotary shaft of the motor are arranged to extend substantially parallel.

19. A door opening and closing system in an electric oven, the system comprising:

at least one protrusion protruded from one surface of a door;

a first door opening and closing structure; and a second door opening and closing structure including:

a switch unit; and a rotary lever being rotated by the at least one protrusion at a first side of the rotary lever when the door is moved from an open position to a closed position, the rotary lever having a first engagement portion and a second engagement portion at a second side of the rotary lever opposite the first side, the first engagement portion and second engagement portion coming in contact in seriatim with the switch unit as the rotary lever is rotated to indicate when the door is in the open position, an intermediate position between the open position and the closed position, and the closed position; and the first door opening and closing structure maintaining the door in a locking state after the second door opening and closing structure indicates that the door is in the closed position.

20. The system according to claim 19, further comprising a rotary guide protrusion provided at the first side of the rotary lever to be extended toward the protrusion.

21. The system according to claim 19, wherein the first engagement portion and second engagement portion are arranged in a stepped relationship.

22. The system according to claim 19, wherein the switch unit includes two switch contacts arranged to be contacted in seriatim by the first and second engagement portions.

23. The system according to claim 19, wherein the switch unit includes a monitor switch contact and a primary switch contact.

24. The system according to claim 23, wherein, when the monitor switch contact and primary switch contact are engaged, the second door opening and closing structure indicates that the door is in the closed position.

25. The system according to claim 19, wherein the switch unit includes a plurality of micro-switches.

26. The system according to claim 25, wherein, when each micro-switch of the plurality of micro-switches is turned on, the second door opening and closing structure indicates that the door is in the closed position.

27. The system according to claim 19, wherein the second door opening and closing structure includes an elastic spring to assist the rotation of the rotary lever in a direction opposite to an insertion direction of the at least one protrusion.

* * * * *